US007610645B2

(12) United States Patent
Gau

(10) Patent No.: US 7,610,645 B2
(45) Date of Patent: Nov. 3, 2009

(54) FILTER CARTRIDGE CLEANING APPARATUS

(76) Inventor: Ji-Ding Gau, No. 348, Guangfu Rd., Jiali Township, Tainan County (TW)

( * ) Notice: Subject to any disclaimer, the term of this patent is extended or adjusted under 35 U.S.C. 154(b) by 915 days.

(21) Appl. No.: 11/114,855

(22) Filed: Apr. 26, 2005

(65) Prior Publication Data

US 2006/0236476 A1 Oct. 26, 2006

(51) Int. Cl.
*A47L 15/00* (2006.01)

(52) U.S. Cl. ..... 15/56; 15/88.3; 15/77

(58) Field of Classification Search ..... 15/88.1, 15/88.2, 88.3, 56, 77
See application file for complete search history.

(56) References Cited

U.S. PATENT DOCUMENTS 1,945,274 A * 1/1934 Hormel ..... 15/102
3,643,277 A * 2/1972 Durst, Felix ..... 15/77
4,128,326 A * 12/1978 Selak ..... 396/611
4,926,520 A * 5/1990 Watson ..... 15/302
5,040,259 A * 8/1991 Ishii et al. ..... 15/40
5,477,584 A * 12/1995 Thumm ..... 15/302
5,806,137 A * 9/1998 Ishi et al. ..... 15/302

* cited by examiner

*Primary Examiner*—Dung Van Nguyen
(74) *Attorney, Agent, or Firm*—Banger Shia

(57) ABSTRACT

A filter cartridge cleaning apparatus includes a housing, a brush mechanism for cleaning a filter cartridge passing through the housing, a guiding mechanism for feeding the filter cartridge toward a filter cartridge outlet of the housing, a water supply mechanism for supplying water to the filter cartridge, and a transmission mechanism for driving the brush mechanism and the guiding mechanism. The housing has a drain for draining sewage resulting from the cleaning process. The filter cartridge cleaning apparatus may be used with a water recycling apparatus to eliminate waste of water.

7 Claims, 8 Drawing Sheets

FILTER CARTRIDGE CLEANING APPARATUS

BACKGROUND OF THE INVENTION

1. Field of the Invention

The present invention relates to a cleaning apparatus. In particular, the present invention relates to a cleaning apparatus for cleaning filter cartridges.

2. Description of the Related Art

In a factory for electroplating or using chemicals, it is common to mount a filtering apparatus to a piping system for chemical solutions. The filtering apparatus comprises a filtering device having tubular cartridges for filtering chemical solutions after electroplating process or other chemical processing. Generally, a filtering device used in an electroplating factory comprises tens of filter cartridges that must be cleaned for repeated use. Current cleaning operation for cleaning the filter cartridges is manually carried out one by one, which is time-consuming, and the result is unsatisfactory. Lost occurs due to shutdown of the factory for the long-term cleaning of the filter cartridges in addition to a waste in water. Further, the waste water resulting from manual cleaning causes contamination.

SUMMARY OF THE INVENTION

An objective of the present invention is to provide a cleaning apparatus for cleaning filter cartridges to reduce the loss resulting from shutdown of the factory.

Another objective of the present invention is to provide a filter cartridge cleaning apparatus that can be connected to a water recycling apparatus for reducing waste of water.

A filter cartridge cleaning apparatus in accordance with the present invention comprises a housing, a brush mechanism for cleaning a filter cartridge passing through the housing, a guiding mechanism for feeding the filter cartridge toward a filter cartridge outlet of the housing, a water supply mechanism for supplying water to the filter cartridge, and a transmission mechanism for driving the brush mechanism and the guiding mechanism.

The water supply mechanism includes a water inlet tube connected to a water source and a plurality of sprinkling tubes connected to the water inlet tube and arranged along a traveling path of the filter cartridge in the housing. Each sprinkling tube includes a plurality of nozzles for supplying water to the filter cartridge moving along the traveling path, with the filtering cartridge being cleaned by the brush mechanism and with sewage resulting from cleaning of the filter cartridge being drained via a drain of the housing.

Preferably, the housing includes a filter cartridge inlet. The filter cartridge inlet, the filter cartridge outlet, and the drain are respectively defined in a front end, a rear end, and a bottom of the housing.

Preferably, the brush mechanism comprises two vertical brush rods adjacent to the front end of the housing and two horizontal brush rods adjacent to the rear end of the housing. Each of the vertical brush rods and the horizontal brush rods includes a plurality of bristles for cleaning the filter cartridge that is passable through a gap between the vertical brush rods and a gap between the horizontal brush rods.

Preferably, the guiding mechanism comprises a front feeding device and a rear feeding device. Each of the front feeding device and the rear feeding device comprises an upper feeding roller and a lower feeding roller. An elastic element is provided for biasing each upper feeding roller such that a distance between each upper feeding roller and an associated lower feeding roller is smaller than a diameter of the filter cartridge, allowing each upper feeding roller and the associated lower feeding roller to securely clamp the filter cartridge and feed the filter cartridge forward.

Preferably, each sprinkling tube is a rectangular frame with the nozzles formed on an inner perimeter of the frame.

Preferably, the transmission mechanism comprises a motor, a gear train, and at least one chain. The upper and lower feeding rollers of the front feeding device and the rear feeding device and the horizontal and vertical brush rods of the brush mechanism are operably connected to and thus driven by the motor via the gear train and the at least one chain.

The filter cartridge cleaning apparatus may be connected to a water recycling apparatus.

In an arrangement, the water recycling apparatus comprises a deposition tank in communication with the drain, a sludge tank, and a filtering tank. Waste water from the drain enters the deposition tank. Sludge deposited on a bottom of the deposition tank is pumped by a pump into the sludge tank. A bottom of the deposition tank is in communication with a waste water tank. Waste water during transportation of the sludge from the deposition tank to the sludge tank is guided to the waste water tank. An upper end of the deposition tank is in communication with the filtering tank for recycling filtration of water. Filtered water in the filtering tank is fed back by another pump to the water supply mechanism of the filter cartridge cleaning apparatus.

In another arrangement, the water recycling apparatus comprises a receiving tank, a plurality of filters, and a filtering tank. The receiving tank receives sewage from the drain and is connected to the filters. The filters are mounted above the filtering tank for filtering sludge from the waste water. Filtered water from the filters is guided to the filtering tank. Water in the filtering tank is pumped by a pump to the water supply mechanism.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
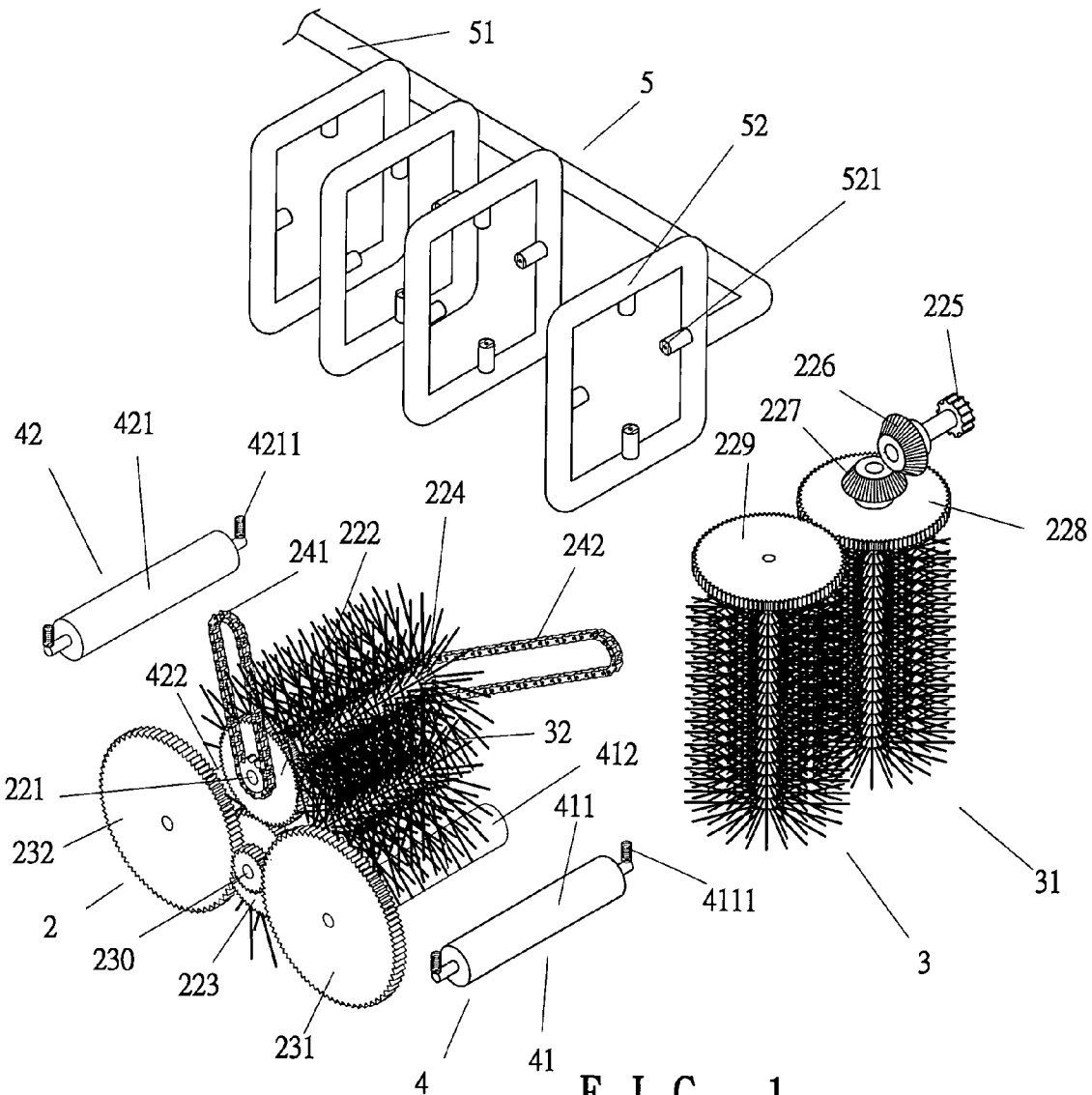
FIG. 1 is an exploded perspective view of a filter cartridge cleaning apparatus in accordance with the present invention.

Referring to FIGS. 1 through 5, a filter cartridge cleaning apparatus 10 in accordance with the present invention comprises a housing 1, a transmission mechanism 2, a brush mechanism 3, a guiding mechanism 4, and a water supply mechanism 5.

Figure 5:
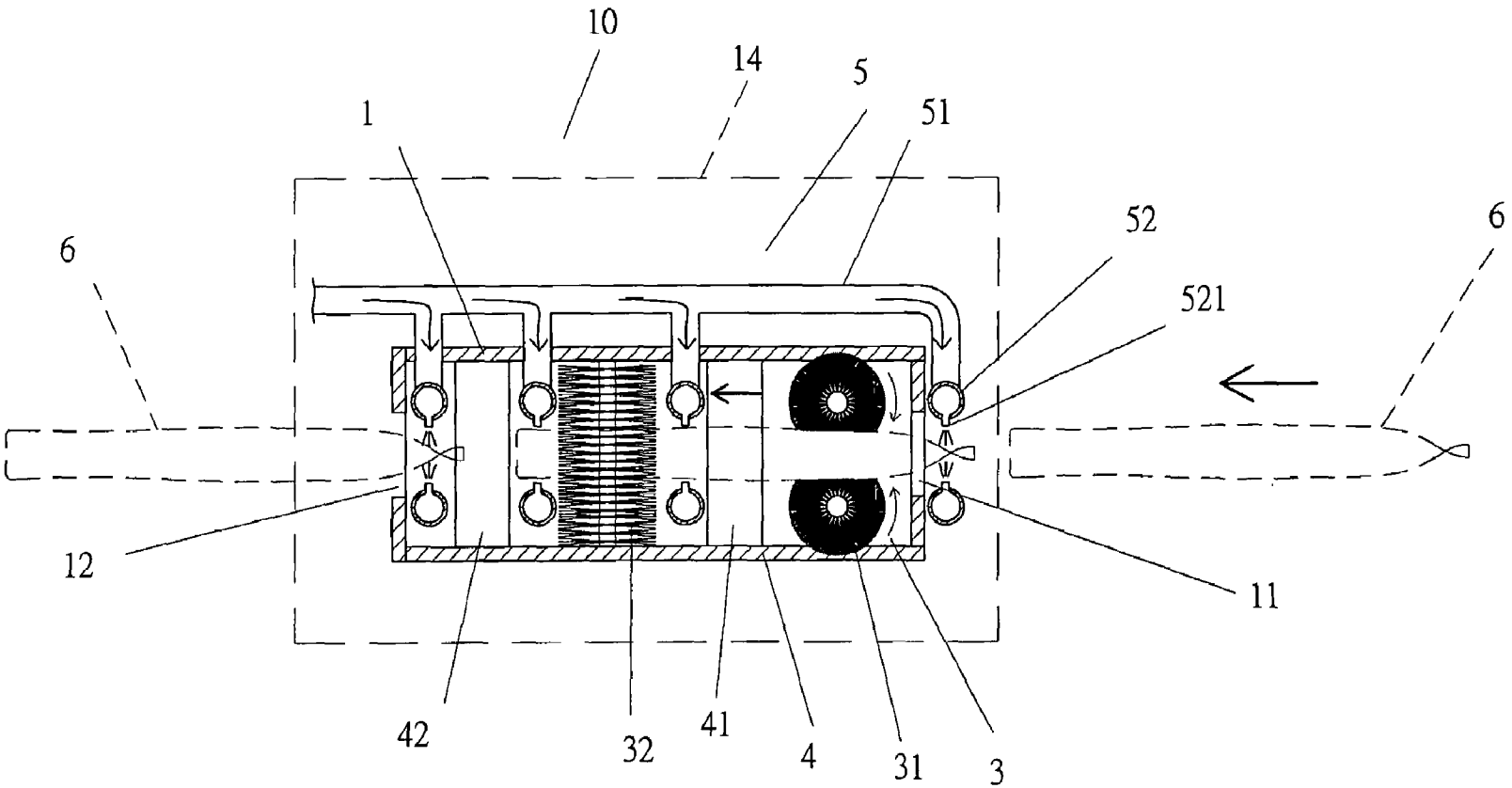
FIG. 5 is a schematic top view illustrating operation of the filter cartridge cleaning apparatus.

As illustrated in FIG. 5, the housing 1 comprises a filter cartridge inlet 11 in a front end thereof from which a filter cartridge 6 enters the housing 1. The housing 1 further includes a filter cartridge outlet 12 in a rear end thereof through which the filter cartridge 6 exits the housing 1. The housing 1 further includes a drain 13 in a bottom thereof for draining sewage. An outer casing 14 is mounted outside the housing 1.

The transmission mechanism 2 includes a motor 21, a gear train including gears 220-232, and a plurality of chains 241 and 242. A gear 220 is mounted on an output shaft (not labeled) of the motor 21 and connected to another gear 221 via a chain 241. The gear 221 moves in synchronism with another gear 222 fixed on an upper horizontal brush rod 32. The gear 222 meshes with a gear 223 that is mounted on an end of a lower horizontal brush rod 32 and that moves in synchronism with the lower horizontal brush rod 32. A gear 224 is mounted on the other end of the upper horizontal brush rod 32 and connected via a chain 242 to a gear 225 on a connecting shaft 240 (FIG. 3).

A bevel gear 226 is mounted on the connecting shaft 240 to move therewith. The bevel gear 226 meshes with another bevel gear 227 that is mounted on an end of a vertical brush rod 33. Also mounted on the end of the vertical brush rod 33 is a gear 228 that meshes with another gear 229 on an end of another vertical brush rod 33. Thus, the horizontal brush rods 32 and the vertical brush rods 33 turn when the motor 21 turns.

Figure 2:
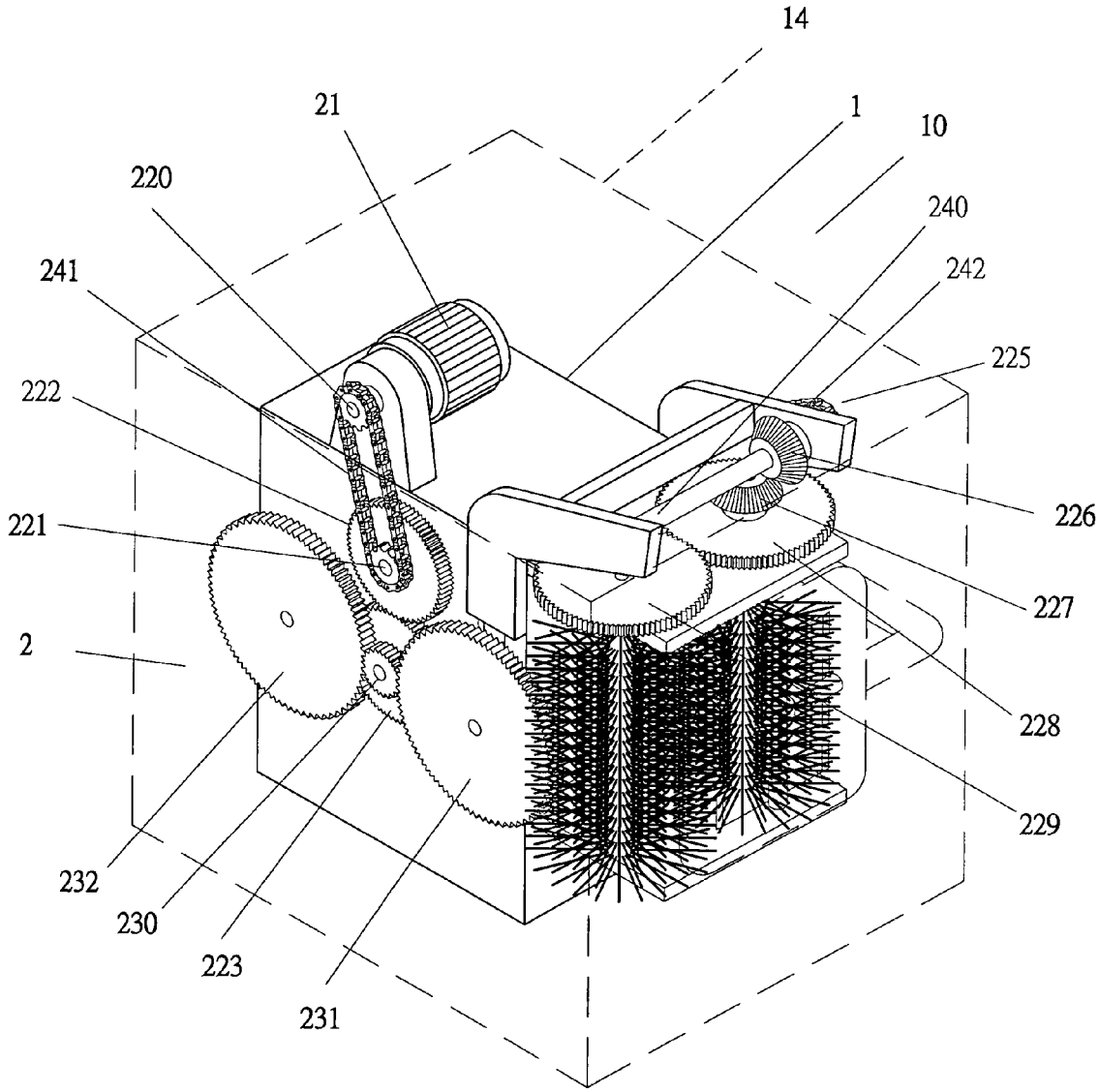
FIG. 2 is a perspective view of the filter cartridge cleaning apparatus in accordance with the present invention.
Figure 4:
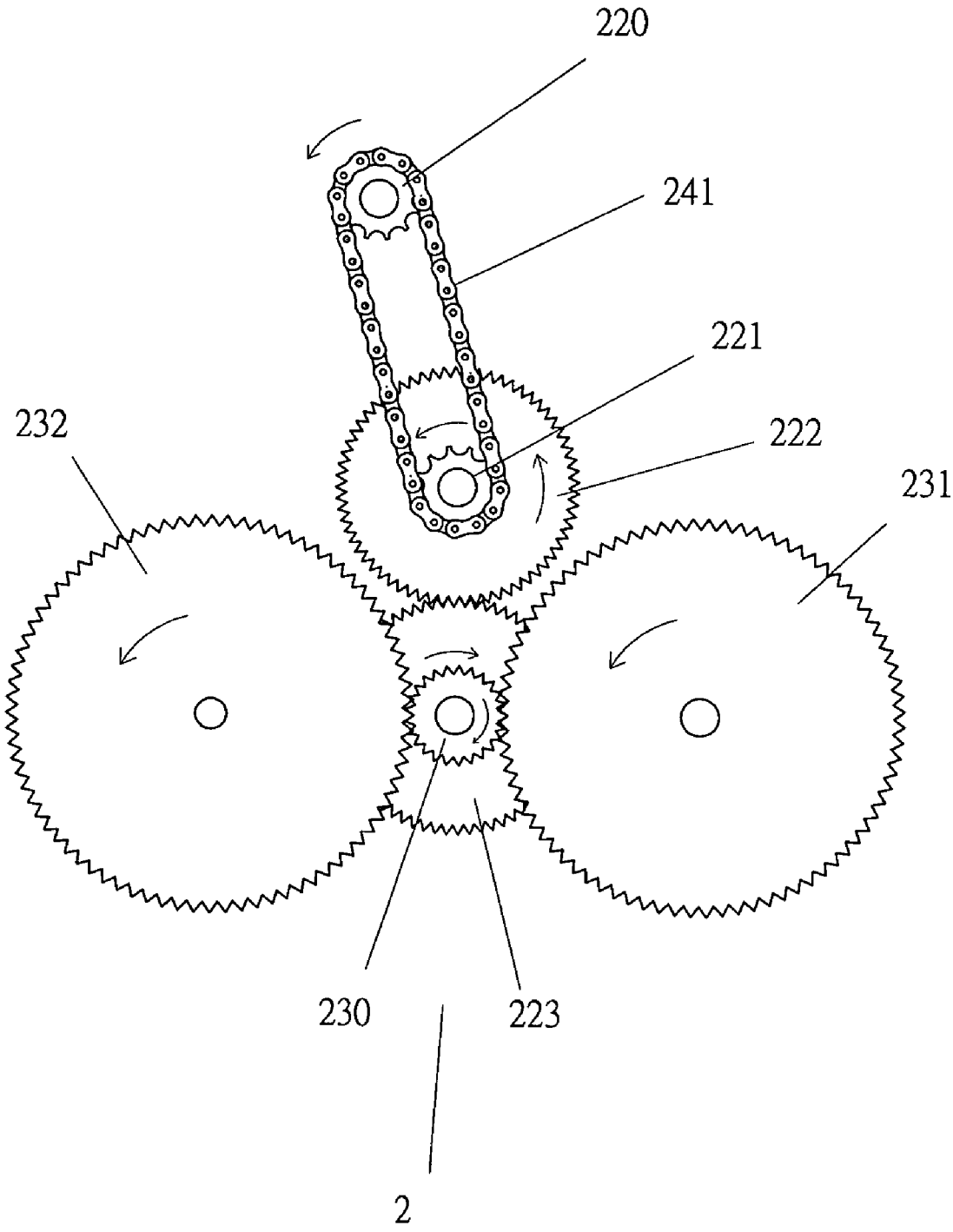
FIG. 4 is a schematic side view of a transmission mechanism of the filter cartridge cleaning apparatus.
Figure 6:
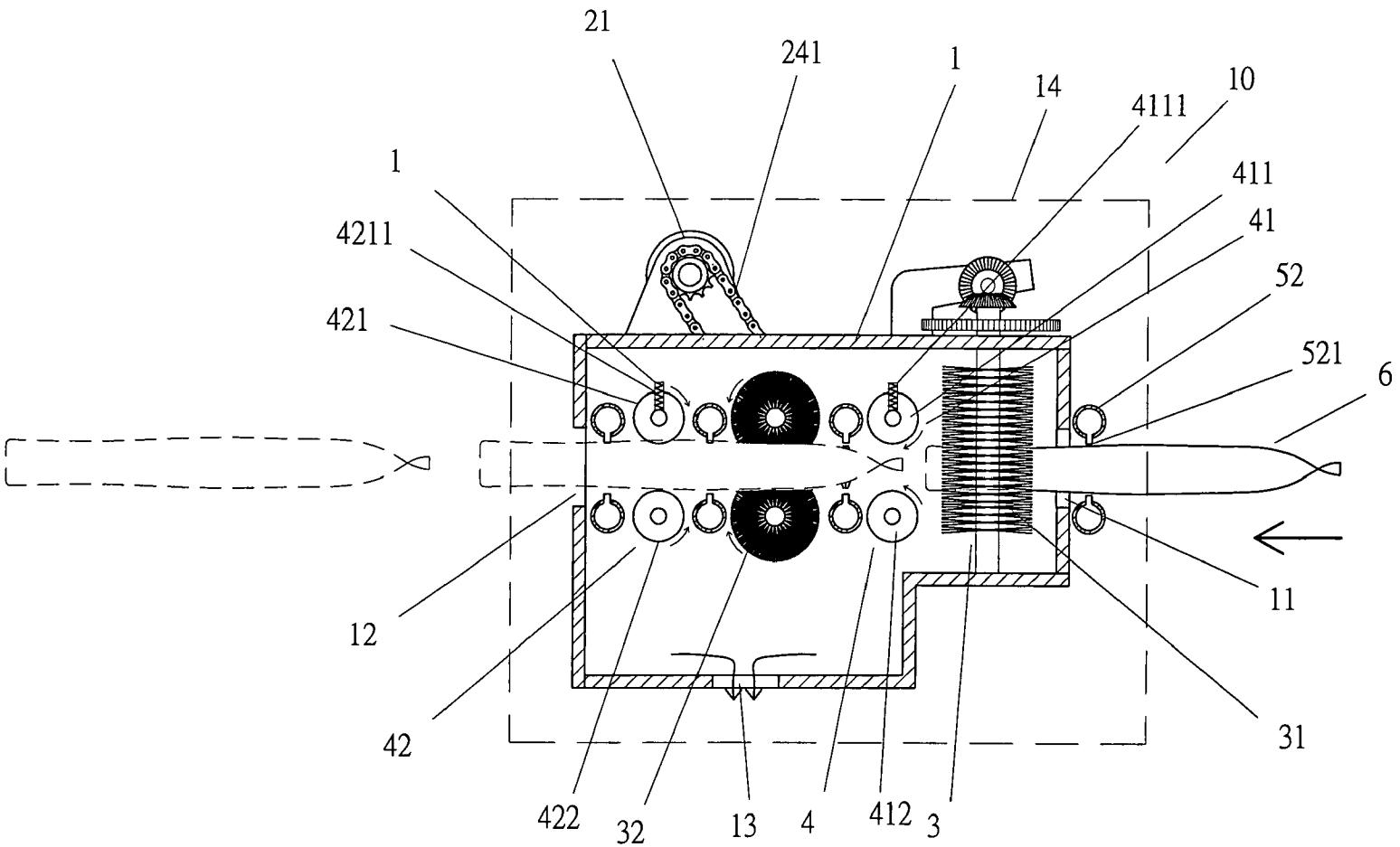
FIG. 6 is schematic side view illustrating operation of the filter cartridge cleaning apparatus.

The gear 223 moves in synchronism with a gear 230 that meshes with two gears 231 and 232 respectively mounted on two feeding rollers 412 and 422 respectively of a front feeding device 41 and a rear feeding device 42 (FIGS. 2, 4, and 6).

Figure 3:
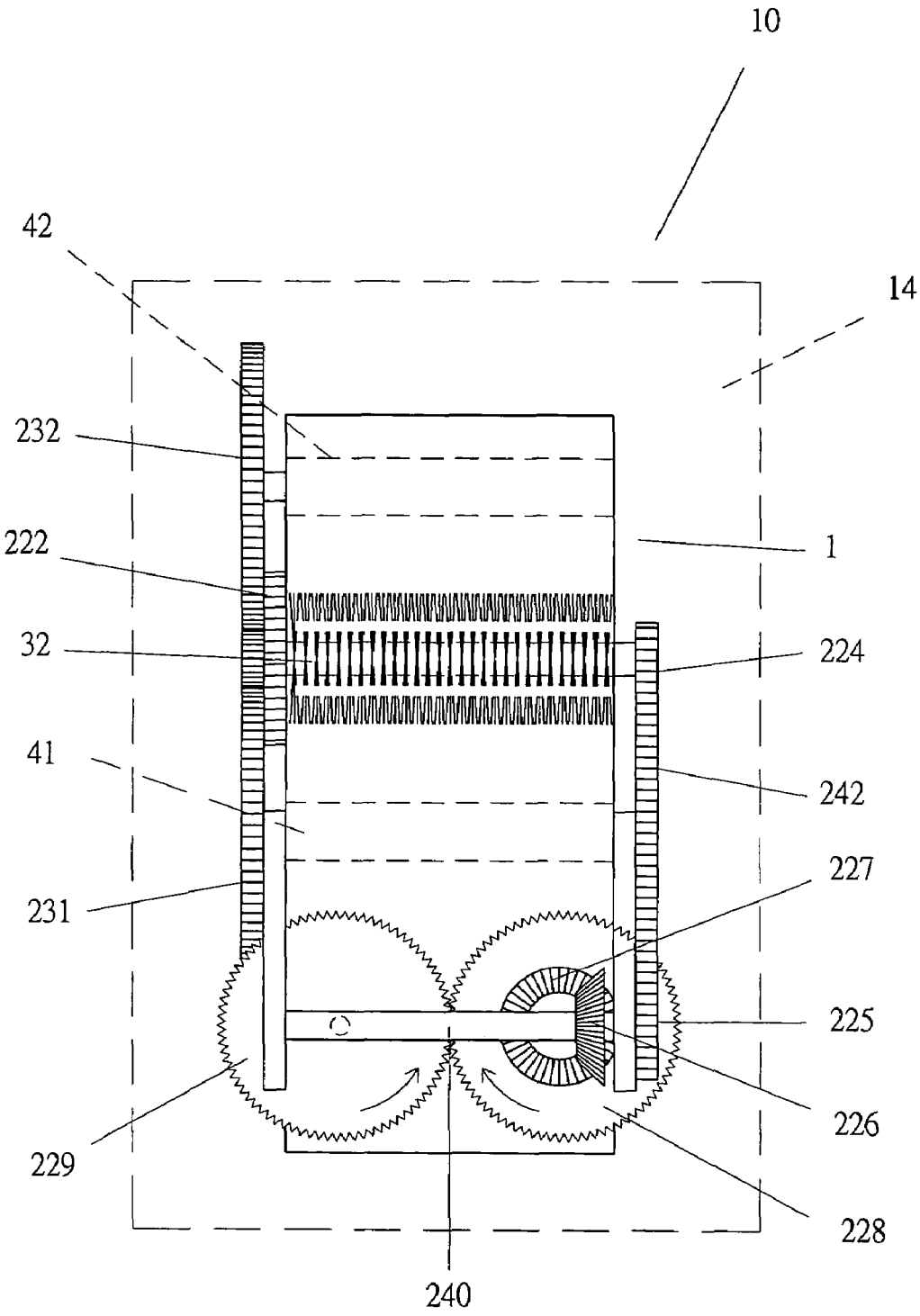
FIG. 3 is a top view of the filter cartridge cleaning apparatus in accordance with the present invention.

Referring to FIGS. 3 and 4, the horizontal brush rods 32, the vertical brush rods 33, and the feeding rollers 412 and 422 turn when the motor 21 turns. Each brush rod 32, 33 includes bristles mounted thereon for cleaning purposes. The horizontal brush rods 32 have a gap therebetween through which the filter cartridge 6 is passable (FIG. 6). The bristles on the horizontal brush rods 32 may reach the filter cartridge 6 for cleaning purposes. Similarly, the vertical brush rods 33 have a gap therebetween through which the filter cartridge 6 is passable (FIG. 5). The bristles on the vertical brush rods 33 may reach the filter cartridge 6 for cleaning purposes.

Referring to FIG. 6, the guiding mechanism 4 includes front and rear feeding devices 41 and 42. The front feeding device 41 is located behind the vertical brush rods 33 and includes upper and lower feeding rollers 411 and 412 that have a gap therebetween through which the filter cartridge 6 passes. The feeding rollers 411 and 412 feed the filter cartridge 6 forward toward the horizontal brush rods 32. The rear feeding device 42 is located between the horizontal brush rods 32 and the outlet 12 and includes upper and lower feeding rollers 421 and 422 that have a gap therebetween through which the filter cartridge 6 passes. The feeding rollers 421 and 422 feed the filter cartridge 6 that has passed through the horizontal brush rods 32 toward the outlet 12. An elastic element 4111 is provided to bias the upper feeding roller 411 such that the distance between the upper feeding roller 411 and the lower feeding roller 412 is smaller than a diameter of the filter cartridge 6, allowing the feeding rollers 411 and 412 to securely clamp the filter cartridge 6 and move the filter cartridge 6 forward. Similarly, an elastic element 4211 is provided to bias the upper feeding roller 421 such that the distance between the upper feeding roller 421 and the lower feeding roller 422 is smaller than a diameter of the filter cartridge 6, allowing the feeding rollers 421 and 422 to securely clamp the filter cartridge 6 and move the filter cartridge 6 forward. Thus, filter cartridges of various sizes can be cleaned due to provision of the elastic elements 4111 and 4211

The water supply mechanism 5 includes a water inlet tube 51 connected to a water source and a plurality of sprinkling tubes 52 in communication with the water inlet tube 51. Preferably, each sprinkling tube 52 is arranged as a rectangular frame along a traveling path of the filter cartridge 6 and includes a plurality of nozzles 521 on an inner perimeter of each frame.

Referring to FIGS. 5 and 6, when the brush rods 32 and 33 and the feeding rollers 411, 412, 421, and 422 turn as a result of turning of the motor 21, the filter cartridge 6 that has entered the housing 1 via the inlet 11 and is moved forward toward the outlet 12 by the feeding rollers 411, 412, 421 and 422. Water is supplied from the nozzles 521 of the sprinkling tubes 52 to the filter cartridge 6 that is cleaned when passing through the vertical brush rods 33 and the horizontal brush rods 32. The cleaned filter cartridge 6 exits the housing 1 via the outlet 12, and the sewage resulting from the cleaning process is drained via the drain 13 that may be connected to a water treating apparatus or a recycling apparatus. Thus, the filter cartridge 6 can be cleaned rapidly and effectively. Loss resulting from shutdown of the factory can be reduced.

Figure 7:
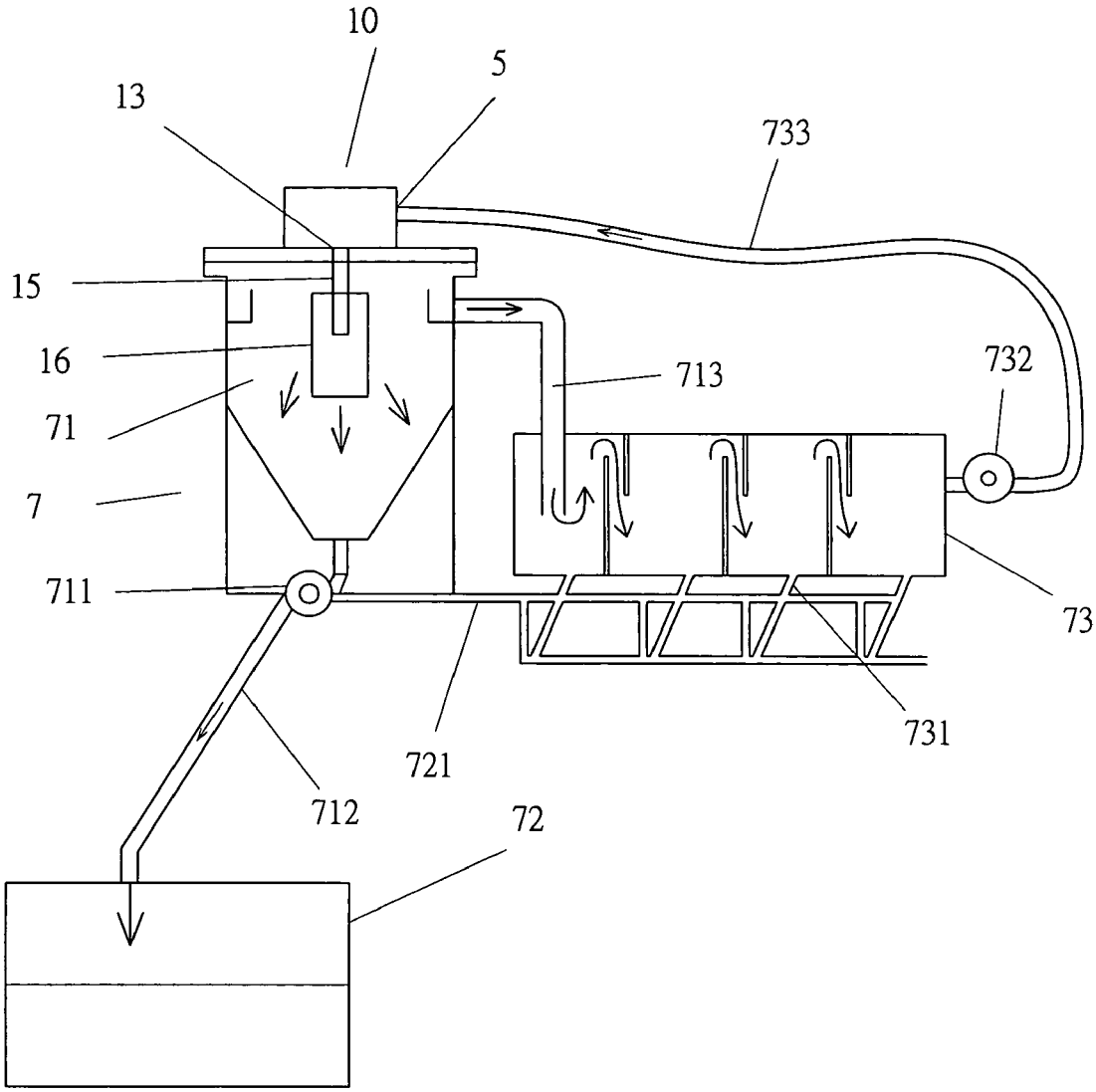
FIG. 7 is a schematic view illustrating an arrangement of a combination of the filter cartridge cleaning apparatus and a water recycling apparatus.

FIG. 7 illustrates an arrangement of an inexpensive water recycling apparatus 7 comprising a deposition tank 71, a sludge tank 72, and a filtering tank 73. The waste water from the drain 13 of the filter cartridge cleaning apparatus 10 enters the deposition tank 71 via a tube 15. A filter 16 may be mounted on the tube 15 for preliminary filtration. Sludge deposited on a bottom of the deposition tank 71 is pumped by a pump 711 into the sludge tank 72 via a tube 712 between the deposition tank 71 and the sludge tank 72. The sludge moved to the sludge tank 72 is processed from the standpoint of environment protection. A tube 721 is connected between a bottom of the deposition tank 71 and a waste water tank (not labeled). The waste water during transportation of the sludge from the deposition tank 71 to the sludge tank 72 is guided to the waste water tank. Further, a tube 713 is connected between an upper end of the deposition tank 71 and the filtering tank 73 in which recycling filtration of water is carried out. Filtered water is fed back by a pump 732 to the water supply mechanism 5 of the filter cartridge cleaning apparatus 10 via a tube 733. Optionally, fresh water can be added into the water supply mechanism 5. By such an arrangement, waste of water can be eliminated.

Figure 8:
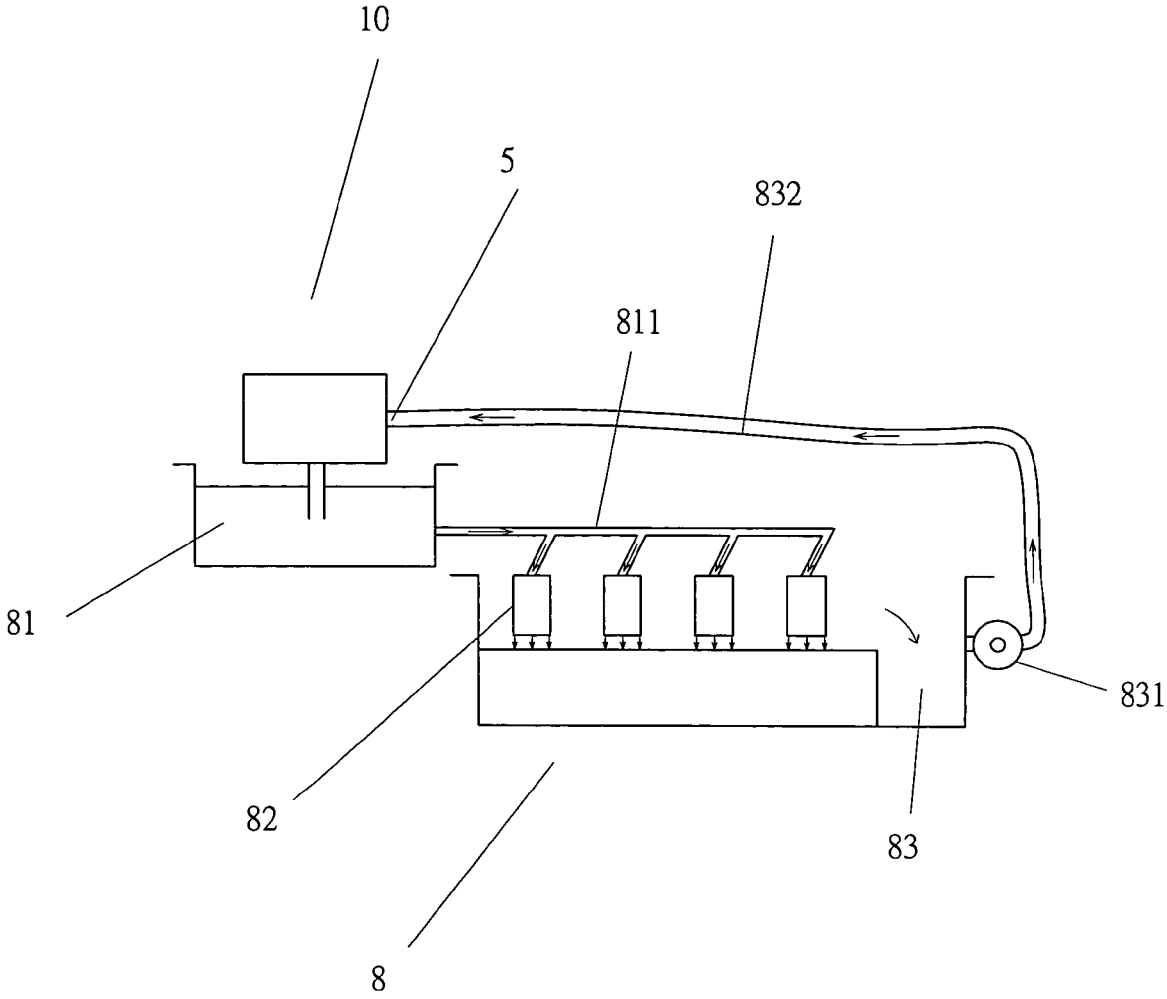
FIG. 8 is a schematic view illustrating an arrangement of a combination of the filter cartridge cleaning apparatus and another water recycling apparatus.

FIG. 8 illustrates an arrangement of another inexpensive water recycling apparatus 8 comprising a receiving tank 81, a plurality of filters 82, and a filtering tank 83. The receiving tank 81 receives sewage from the drain 13 of the filter cartridge cleaning apparatus 10 and is connected to the filters 82 via a piping 811. The filters 82 are mounted above the filtering tank 83 for filtering sludge from the waste water. The filtered water from the filters 82 is guided to the filtering tank 83. The filters 82 are replaced with new ones or cleaned periodically. The water in the filtering tank 83 is pumped by a pump 831 to the water supply mechanism 5 via a tube 832. By such an arrangement, waste of water can be eliminated.

As apparent from the foregoing, filter cartridges can be cleaned rapidly and effectively by the filter cartridge cleaning apparatus 10. The time for cleaning is relatively short and the cost resulting from cleaning of the filter cartridges and shutdown of the factory is low. Further, the cleaning effect is satisfactory. Further, filter cartridges of various sizes can be cleaned, and the cleaning operation can be carried out by a single motor. The sewage resulting from cleaning is drained via the drain 13 without the risk of contamination. Further, the filter cartridge cleaning apparatus can be used with a water recycling apparatus to eliminate waste of water.

Although specific embodiments have been illustrated and described, numerous modifications and variations are still possible without departing from the essence of the invention. The scope of the invention is limited by the accompanying claims.

What is claimed is:

1. A filter cartridge cleaning apparatus comprising:

a housing comprising a filter cartridge inlet, a filter cartridge outlet, and a drain;

a brush mechanism for cleaning a filter cartridge passing through the housing;

a guiding mechanism for feeding the filter cartridge toward the filter cartridge outlet;

a water supply mechanism including a water inlet tube adapted to be connected to a water source and a plurality of sprinkling tubes connected to the water inlet tube and arranged along a traveling path of the filter cartridge in the housing, each said sprinkling tube including a plurality of nozzles for supplying water to the filter cartridge moving along the traveling path, with the filtering cartridge being cleaned by the brush mechanism and with sewage resulting from cleaning of the filter cartridge being drained via the drain of the housing; and a transmission mechanism for driving the brush mechanism and the guiding mechanism, wherein the brush mechanism comprises two vertical brush rods adjacent to a front end of the housing and two horizontal brush rods adjacent to a rear end of the housing, each of the vertical brush rods and the horizontal brush rods including a plurality of bristles for cleaning the filter cartridge that is passable through a gap between the vertical brush rods and a gap between the horizontal brush rods.

2. The filter cartridge cleaning apparatus as claimed in claim 1, wherein the filter cartridge inlet, the filter cartridge outlet, and the drain are respectively defined in a front end, a rear end, and a bottom of the housing.

3. The filter cartridge cleaning apparatus as claimed in claim 1, wherein each said sprinkling tube is a rectangular frame with the nozzles formed on an inner perimeter of the frame.

4. The filter cartridge cleaning apparatus as claimed in claim 1, wherein the transmission mechanism comprises a motor, a gear train, and at least one chain, and wherein the horizontal brush rods, the vertical brush rods, and the guiding mechanism are operably connected to and thus driven by the motor via the gear train and said at least one chain.

5. A filter cartridge cleaning apparatus comprising:

a housing comprising a filter cartridge inlet, a filter cartridge outlet, and a drain;

a brush mechanism for cleaning a filter cartridge passing through the housing;

a guiding mechanism for feeding the filter cartridge toward the filter cartridge outlet;

a water supply mechanism including a water inlet tube adapted to be connected to a water source and a plurality of sprinkling tubes connected to the water inlet tube and arranged along a traveling path of the filter cartridge in the housing, each said sprinkling tube including a plurality of nozzles for supplying water to the filter cartridge moving along the traveling path, with the filtering cartridge being cleaned by the brush mechanism and with sewage resulting from cleaning of the filter cartridge being drained via the drain of the housing; and a transmission mechanism for driving the brush mechanism and the guiding mechanism, wherein the guiding mechanism comprises a front feeding device and a rear feeding device, each of the front feeding device and the rear feeding device comprising an upper feeding roller and a lower feeding roller, further comprising an elastic element for biasing each said upper feeding roller such that a distance between each said upper feeding roller and an associated one of the lower feeding rollers is smaller than a diameter of the filter cartridge, allowing each said upper feeding roller and the associated lower feeding roller to securely clamp the filter cartridge and feed the filter cartridge forward, and wherein the transmission mechanism comprises a motor, a gear train, and at least one chain, and wherein the upper and lower feeding rollers of the front feeding device and the rear feeding device and the brush mechanism are operably connected to and thus driven by the motor via the gear train and said at least one chain.

6. A filter cartridge cleaning apparatus comprising:

a housing comprising a filter cartridge inlet, a filter cartridge outlet, and a drain;

a brush mechanism for cleaning a filter cartridge passing through the housing;

a guiding mechanism for feeding the filter cartridge toward the filter cartridge outlet;

a water supply mechanism including a water inlet tube adapted to be connected to a water source and a plurality of sprinkling tubes connected to the water inlet tube and arranged along a traveling path of the filter cartridge in the housing, each said sprinkling tube including a plurality of nozzles for supplying water to the filter cartridge moving along the traveling path, with the filtering cartridge being cleaned by the brush mechanism and with sewage resulting from cleaning of the filter cartridge being drained via the drain of the housing;

a transmission mechanism for driving the brush mechanism and the guiding mechanism; and a water recycling apparatus in communication with the drain, wherein the water recycling apparatus comprises a deposition tank in communication with the drain, a sludge tank, and a filtering tank, waste water from the drain entering the deposition tank, sludge deposited on a bottom of the deposition tank being pumped by a pump into the sludge tank, a bottom of the deposition tank being in communication with a waste water tank, waste water during transportation of the sludge from the deposition tank to the sludge tank being guided to the waste water tank, an upper end of the deposition tank being in communication with the filtering tank for recycling filtration of water, filtered water in the filtering tank being fed back by another pump to the water supply mechanism of the filter cartridge cleaning apparatus.

7. A filter cartridge cleaning apparatus comprising:

a housing comprising a filter cartridge inlet, a filter cartridge outlet, and a drain;

a brush mechanism for cleaning a filter cartridge passing through the housing;

a guiding mechanism for feeding the filter cartridge toward the filter cartridge outlet;

a water supply mechanism including a water inlet tube adapted to be connected to a water source and a plurality of sprinkling tubes connected to the water inlet tube and arranged along a traveling path of the filter cartridge in the housing, each said sprinkling tube including a plurality of nozzles for supplying water to the filter cartridge moving along the traveling path, with the filtering cartridge being cleaned by the brush mechanism and with sewage resulting from cleaning of the filter cartridge being drained via the drain of the housing;

a transmission mechanism for driving the brush mechanism and the guiding mechanism; and a water recycling apparatus in communication with the drain, wherein the water recycling apparatus comprises a receiving tank, a plurality of filters, and a filtering tank, the receiving tank receiving sewage from the drain and being connected to the filters, the filters being mounted above the filtering tank for filtering sludge from the waste water, filtered water from the filters being guided to the filtering tank, water in the filtering tank being pumped by a pump to the water supply mechanism.

* * * * *